US010150631B1

(12) United States Patent
Kato

(10) Patent No.: US 10,150,631 B1
(45) Date of Patent: Dec. 11, 2018

(54) SHEET CONVEYANCE APPARATUS AND SHEET CONVEYANCE METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Nobuyuki Kato, Nagaizumi Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/712,578

(22) Filed: Sep. 22, 2017

(51) Int. Cl.

| | |
|---|---|
| ***B65H 7/02*** | (2006.01) |
| ***B65H 29/20*** | (2006.01) |
| ***B65H 27/00*** | (2006.01) |
| ***B65H 5/06*** | (2006.01) |

(52) U.S. Cl.
CPC ..... *B65H 7/02* (2013.01); *B65H 5/06* (2013.01); *B65H 27/00* (2013.01); *B65H 29/20* (2013.01); *B65H 2404/15* (2013.01); *B65H 2404/193* (2013.01); *B65H 2511/212* (2013.01); *B65H 2513/21* (2013.01); *B65H 2513/53* (2013.01); *B65H 2515/842* (2013.01); *B65H 2557/652* (2013.01); *B65H 2601/121* (2013.01); *G03G 2215/00721* (2013.01)

(58) Field of Classification Search
CPC . B65H 5/06; B65H 5/062; B65H 7/00; B65H 7/02; B65H 27/00; B65H 2511/16; B65H 2511/166; B65H 2511/21; B65H 2511/212; B65H 2404/193; B65H 2513/20; B65H 2513/21; B65H 2513/22; B65H 2513/53; B65H 2515/842; B65H 2601/121; B65H 2601/522; B65H 2557/652
See application file for complete search history.

(56) References Cited

U.S. PATENT DOCUMENTS

| | | | | |
|---|---|---|---|---|
| 5,342,037 | A * | 8/1994 | Martin | B65H 3/06 271/111 |
| 6,685,133 | B1 * | 2/2004 | Kojo | B65H 26/02 242/563 |
| 2006/0284060 | A1 * | 12/2006 | Watanabe | B65H 27/00 250/231.1 |
| 2009/0079129 | A1 * | 3/2009 | Yamasaki | B65H 5/062 271/256 |

FOREIGN PATENT DOCUMENTS

| | | |
|---|---|---|
| JP | 2000-118759 | 4/2000 |
| JP | 2007-64898 | 3/2007 |
| JP | 2007-79287 | 3/2007 |
| JP | 2009-42196 | 2/2009 |

* cited by examiner

*Primary Examiner* — Prasad V Gokhale
(74) *Attorney, Agent, or Firm* — Amin, Turocy & Watson LLP

(57) ABSTRACT

In accordance with an embodiment, a sheet conveyance apparatus comprises a roller, an acceleration sensor, and a controller. The roller conveys a sheet. The acceleration sensor is attached to the roller to output a signal indicating a direction of gravitational acceleration applied to the roller at the time the roller rotates. The controller acquires cumulative angle at which the roller rotates based on the signal output by the acceleration sensor. The controller determines whether to replace the roller based on the cumulative angle acquired by the rotation angle acquisition section.

9 Claims, 12 Drawing Sheets

901

| ROLLER ID | ROTATION ANGLE OF ROLLER(deg) |
|---|---|
| A-1 | 16000 |

902 992

| ROLLER ID | FIRST ACQUISITION ANGLE(deg) | SECOND ACQUISITION ANGLE(deg) | NORMAL ROTATION ANGLE DIFFERENCE (deg) | ANGLE DIFFERENCE RANGE (deg) |
|---|---|---|---|---|
| A-1 | 93000 | 103000 | 10000 | 200 |
| A-2 | 72200 | 80200 | 8000 | 300 |
| A-3 | 100500 | 120500 | 9500 | 100 |
| A-4 | 68000 | 69000 | 8500 | 500 |
| ⋮ | ⋮ | ⋮ | ⋮ | ⋮ |

903

993

| ROLLER ID | FIRST ACQUISITION ANGLE(deg) | SECOND ACQUISITION ANGLE(deg) | TYPE OF ROLLER | COUNTER ROLLER | DIAMETER OF ROLLER (cm) |
|---|---|---|---|---|---|
| A-1 | 10000 | 15000 | DRIVING | 160-2 | 2 |
| A-2 | 20000 | 30000 | DRIVEN | 160-1 | 1 |
| A-5 | 3000 | 6000 | DRIVING | 160-6 | 2 |
| A-6 | 3000 | 6000 | DRIVEN | 160-5 | 500 |
| ⋮ | ⋮ | ⋮ | ⋮ | ⋮ | ⋮ |

FIG.13

SHEET CONVEYANCE APPARATUS AND SHEET CONVEYANCE METHOD

FIELD

Embodiments described herein relate generally to a sheet conveyance apparatus and a sheet conveyance method.

BACKGROUND

Generally, an image forming apparatus conveys a sheet by a roller. The roller wears during the use. Conventionally, a replacement time of the roller is determined based on the number of sheets subjected to image formation. However, as there are various sizes of the sheets conveyed by the roller, the amount of wear of the roller caused by conveyance of one sheet with different size is different. Furthermore, even at the time the image forming apparatus does not convey a sheet (e.g., during a warm-up operation), the roller rotates and wears in some cases. Therefore, in the determination based on the number of sheets on which the image formation is performed, there is a case in which the replacement time of the roller is not necessarily an appropriate timing.

BRIEF DESCRIPTION OF THE DRAWINGS

FIG. 13 is a diagram illustrating a specific example of roller management information according to a modification.

DETAILED DESCRIPTION

In accordance with an embodiment, a sheet conveyance apparatus comprises a roller, an acceleration sensor, a rotation angle acquisition section and a replacement determination section. The roller conveys a sheet. The acceleration sensor is attached to the roller to output a signal indicating a direction of gravitational acceleration applied to the roller at the time the roller rotates. The controller acquires cumulative angle at which the roller rotates based on the signal output by the acceleration sensor. The controller determines whether to replace the roller based on the cumulative angle acquired by the rotation angle acquisition section.

Hereinafter, a sheet conveyance apparatus and a sheet conveyance method of the embodiment are described with reference to the accompanying drawings. Hereinafter, the sheet conveyance apparatus of the embodiment is described by exemplifying an image forming apparatus.

Figure 1:
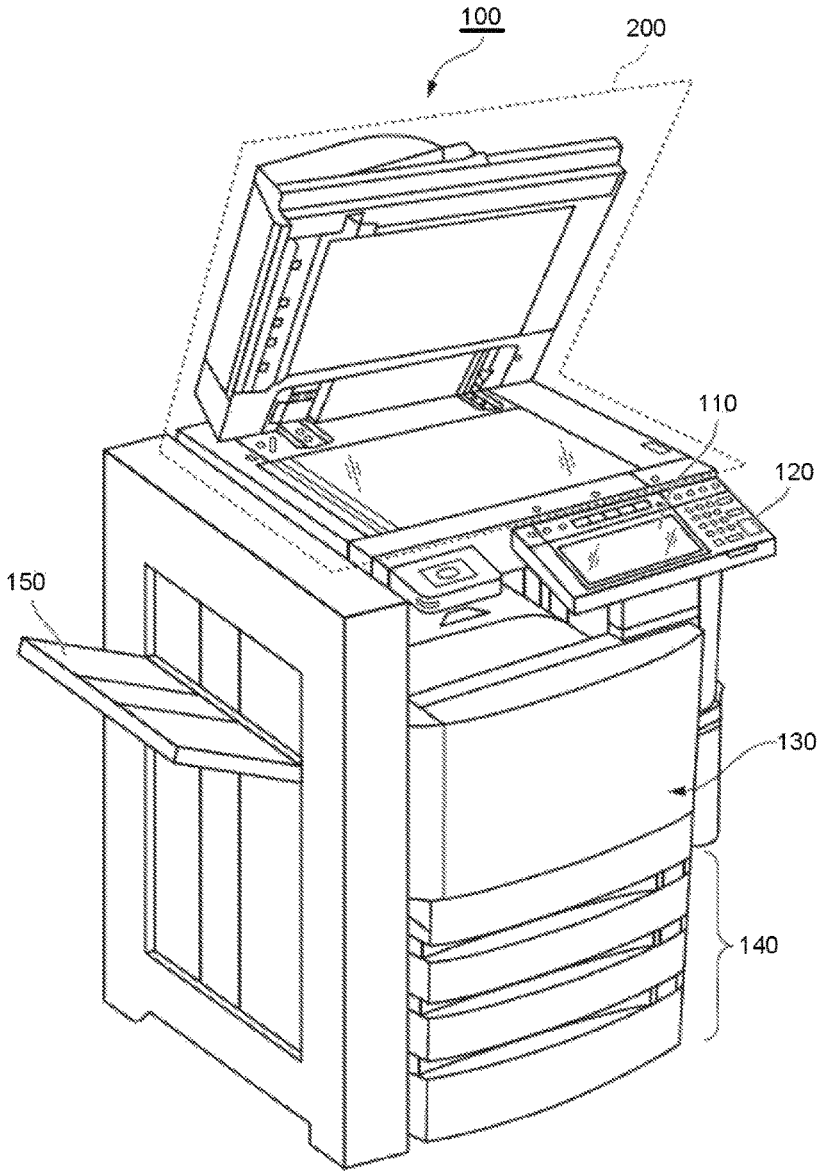
FIG. 1 is an external view exemplifying the overall constitution of an image forming apparatus according to an embodiment.

FIG. 1 is an external view schematically illustrating an image forming apparatus 100 according to the embodiment. The image forming apparatus 100 is, for example, a multifunctional peripheral. The image forming apparatus 100 includes a display 110, a control panel 120, a printer 130, a sheet housing section 140, a sheet discharge section 150 and an image reading section 200. Furthermore, the printer 130 of the image forming apparatus 100 may be a device for fixing a toner image, or an inkjet type device.

The image forming apparatus 100 forms an image on a sheet using a developer such as a toner. The sheet is, for example, a paper or a label paper. The sheet may be an optional object as long as the image forming apparatus 100 can form an image on a surface thereof.

The display 110 is an image display device such as a liquid crystal display, an organic EL (Electro Luminescence) display and the like. The display 110 displays various information relating to the image forming apparatus 100.

The control panel 120 includes a plurality of buttons. The control panel 120 receives an operation by a user. The control panel 120 outputs a signal in response to an operation executed by the user to a controller of the image forming apparatus 100. Furthermore, the display 110 and the control panel 120 may be constituted as an integrated touch panel.

The printer 130 forms an image on the sheet based on image information generated by the image reading section 200 or image information received through a communication path. The printer 130 forms an image through the following processing, for example. An image forming section of the printer 130 forms an electrostatic latent image on a photoconductive drum based on the image information. The image forming section of the printer 130 forms a visible image by attaching the developer to the electrostatic latent image. Toner is exemplified as a concrete example of the developer. A transfer section of the printer 130 transfers the visible image onto the sheet. A fixing section of the printer 130 fixes the visible image on the sheet by heating and pressurizing the sheet. The sheet on which the image is formed may be a sheet housed in the sheet housing section 140, or a sheet that is manually fed.

The sheet housing section 140 houses the sheet used in the image formation by the printer 130.

The sheet discharge section 150 discharges the sheet subjected to an image forming processing by the printer 130.

The image reading section 200 reads the image information which is a reading object as intensity of light. The image reading section 200 records the read image information. The recorded image information may be transmitted to another information processing apparatus via a network. The recorded image information may be used to form an image on the sheet by the printer 130.

Figure 2:
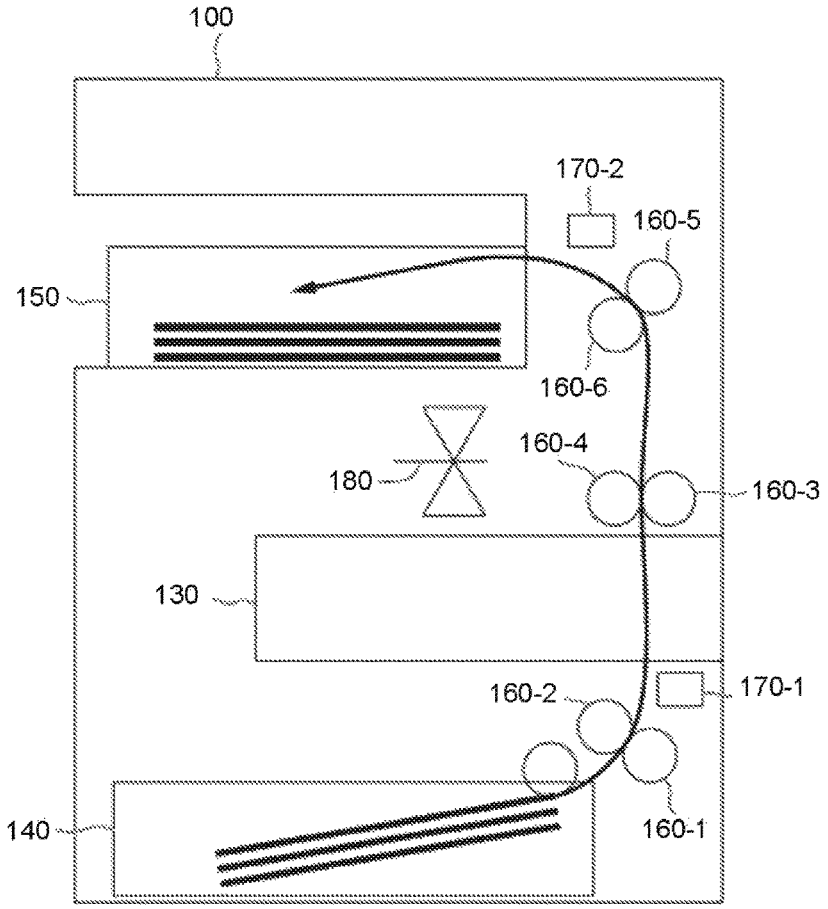
FIG. 2 is a cross-sectional view schematically illustrating the image forming apparatus according to the embodiment.

FIG. 2 is a cross-sectional view exemplifying the internal constitution of the image forming apparatus 100 according to the embodiment. The image forming apparatus 100 includes the sheet housing section 140, the sheet discharge section 150, conveyance rollers 160-1~160-6, sheet passing sensors 170-1 and 170-2, a housing antenna 180. In FIG. 2, the components same as those in FIG. 1 are donated with the same reference numerals, and the description thereof is omitted. If it is not necessary to distinguish the conveyance rollers 160-1~160-6, the conveyance rollers 160-1~160-6 are simply referred to as a conveyance roller 160. If the sheet passing sensors 170-1 and 170-2 are not distinguished, the sheet passing sensors 170-1 and 170-2 are simply referred to as a sheet passing sensor 170. If the sheet passing sensors 170-1 and 170-2 are distinguished from each other, the sheet passing sensor 170-1 is referred to as a first sheet passing sensor 170-1. The sheet passing sensor 170-2 is referred to as a second sheet passing sensor 170-2.

The conveyance roller 160 conveys the sheet. The conveyance roller 160 is constituted as a driving roller or a driven roller. The driving roller actively rotates by receiving supply of the power and the driven roller rotates passively by contacting with the driving roller. For example, the conveyance rollers 160-1, 160-3 and 160-5 in FIG. 2 are the driving rollers and the conveyance rollers 160-2, 160-4 and 160-6 are the driven rollers. The pair of the driving roller and the driven roller rotates while sandwiching the sheet, and in this way, the sheet is conveyed. The diameter of each conveyance roller 160 may be different. In the present embodiment, the rotation of the roller means rotating by rotation of the roller.

Figure 3:
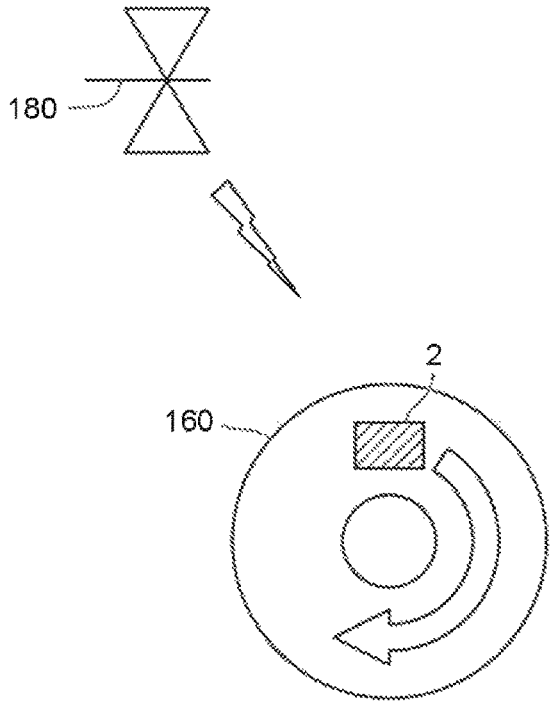
FIG. 3 is a diagram illustrating the specific constitution of a conveyance roller according to the embodiment.

FIG. 3 is a diagram illustrating a specific example of the constitution of the conveyance roller 160 according to the embodiment. The conveyance roller 160 rotates, for example, in a direction shown by an arrow in FIG. 3. The conveyance roller 160 has an IC tag 2. Specifically, the conveyance roller 160 is molded by embedding the IC tag 2 in the conveyance roller 160. In other words, the conveyance roller 160 has the IC tag 2 therein. In this case, the conveyance roller 160 is constituted in such a manner that it is unknown from the appearance that the IC tag 2 is embedded in the conveyance roller 160. Specifically, for example, if the conveyance roller 160 is made from rubber, the conveyance roller 160 is molded with the IC tag 2 embedded in the rubber. The conveyance roller 160-*i* (i is an integer of 1~6) has an IC tag 2-*i*. Hereinafter, if it is not necessary to distinguish the IC tag 2-1~IC tag 2-6, the IC tag 2-1~IC tag 2-6 are simply referred to as the IC tag 2.

The IC tag 2 acquires information (hereinafter, referred to as "rotation angle information") indicating an angle at which the conveyance roller 160 rotates. Specifically, the IC tag 2 has an acceleration sensor and acquires the rotation angle information by a signal (hereinafter, referred to as a "gravity signal") indicating a direction of gravitational acceleration output by the acceleration sensor.

Returning to the description in FIG. 2. The sheet passing sensor 170 detects that the sheet passes through a predetermined position. The sheet passing sensor 170 may be any sensor as long as it can detect the sheet. For example, the sheet passing sensor 170 may acquire reflected light of infrared ray emitted toward a predetermined position on a conveyance path used for conveying the sheet to detect the presence or absence of the sheet according to intensity of the reflected light. Hereinafter, a predetermined position on the conveyance path where the first sheet passing sensor 170-1 detects the passing of the sheet is referred to as a first detection position. A predetermined position on the conveyance path where the second the sheet passing sensor 170-2 detects the passing of the sheet is referred to as a second detection position.

The housing antenna 180 radiates electromagnetic wave for conveying power to supply the power to the IC tag 2. The housing antenna 180 acquires individual roller management information from the IC tag 2.

Figure 4:
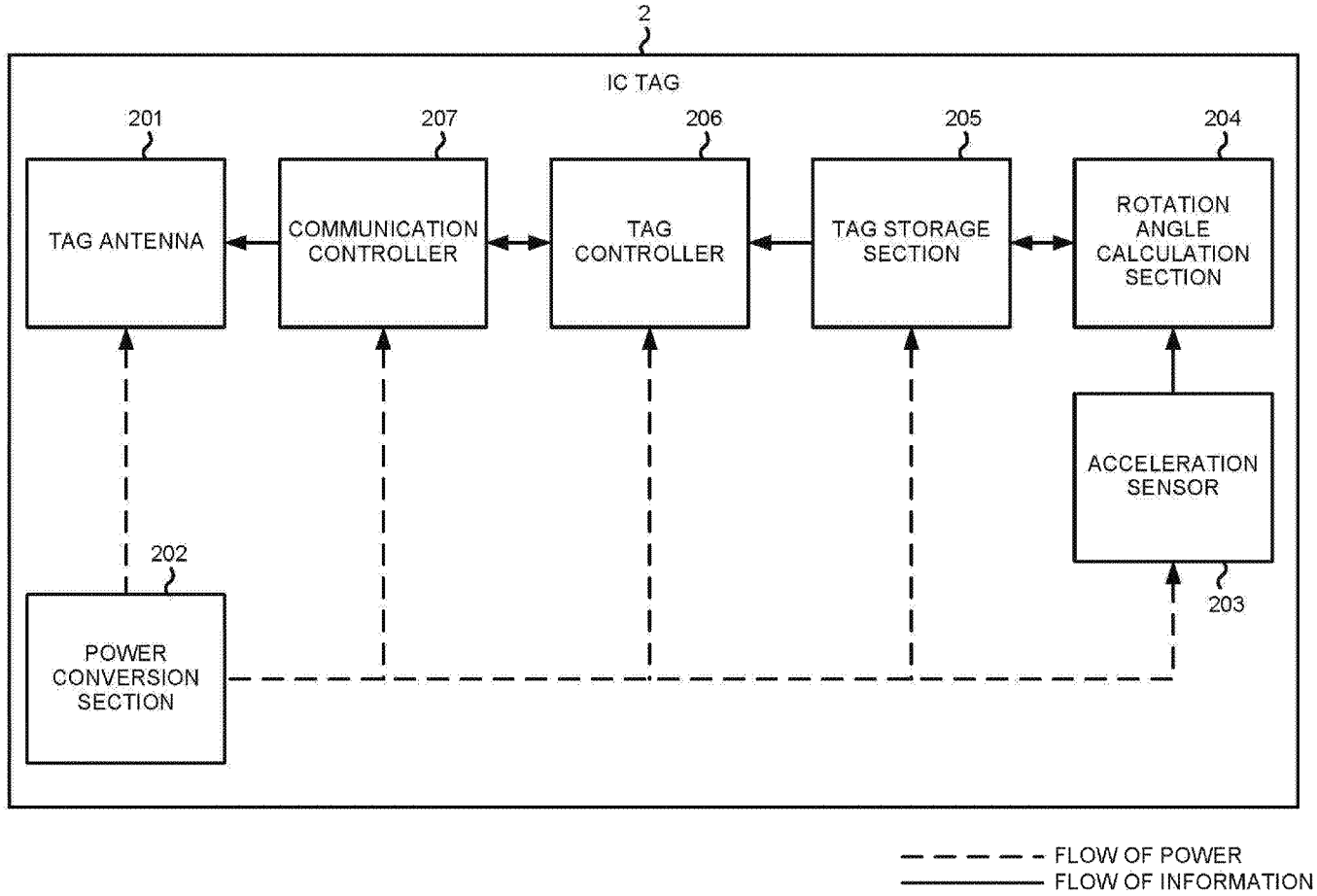
FIG. 4 is a diagram illustrating a specific example of the functional components of an IC tag according to the embodiment.

FIG. 4 is a diagram illustrating a specific example of the functional components of the IC tag 2 according to the embodiment. The IC tag 2 includes a tag antenna 201, a power conversion section 202, an acceleration sensor 203, a rotation angle calculation section 204, a tag storage section 205, a tag controller 206 and a communication controller 207. In FIG. 4, the dotted arrows indicate the flow of power and the solid arrows indicate the flow of information.

The tag antenna 201 receives the electromagnetic wave for carrying the signal and the power. For example, this electromagnetic wave is transmitted from the housing antenna 180.

The power conversion section 202 converts the electromagnetic wave acquired by the tag antenna 201 to electric power and supplies it to each functional section of the IC tag 2. The power conversion section 202 and the tag antenna 201 may be the same coils. An antenna formed by a coil converts the electromagnetic wave received by the coil to a current and a voltage and conducts the current and the voltage obtained by the conversion to each function section connected to the antenna. The antenna formed by the coil not only receives the electromagnetic wave but also has a power conversion function.

The acceleration sensor 203 outputs a gravity signal.

The rotation angle calculation section 204 acquires the gravity signal output by the acceleration sensor 203 and calculates the cumulative angle of rotation of the conveyance roller 160 to which the IC tag 2 is attached. The cumulative angle indicates an angle at which the conveyance roller 160 rotates compared to a state (hereinafter referred to as an "initial state") of the conveyance roller 160 at the initial time point. The cumulative angle may be greater than 360 deg. The cumulative angle is increased each time the conveyance roller 160 rotates after the initial time point. The initial time point is the time point at the beginning of a period which is a calculation object in calculating the cumulative angle. The initial time point is, for example, a time point immediately before the image forming apparatus 100 performs the image formation for the first time. The initial state is, for example, a state of the conveyance roller 160 immediately before the image forming apparatus 100 performs the image formation. For example, if it is assumed that the conveyance roller 160 rotates by 900 deg in one image formation and the cumulative angle in the initial state is 0 deg, the cumulative angle at the time point at which the image forming apparatus 100 performs the image formation on ten sheets becomes 9000 deg.

The tag storage section 205 is a storage device such as a semiconductor storage device. The tag storage section 205 is a nonvolatile memory such as a flash memory or a ROM (Read Only Memory), for example. The tag storage section 205 stores the individual roller management information. The individual roller management information is information on the cumulative angle of the conveyance roller 160 to which the IC tag 2 is attached. The individual roller management information includes an identification number of the conveyance roller 160 to which each IC tag 2 is attached and a magnitude of the cumulative angle of the conveyance roller 160 associated thereto. The identification number of the conveyance roller 160 identifies each of the plurality of conveyance rollers 160 provided in the image forming apparatus 100. For example, the identification number of the conveyance roller 160 stored in the tag storage section 205 of the IC tag 2-2 is previously assigned to the conveyance roller 160-2. Furthermore, the magnitude of the cumulative angle stored in the tag storage section 205 of the IC tag 2-2 is the magnitude of the cumulative angle of the conveyance roller 160-2.

Figures 5, 6:
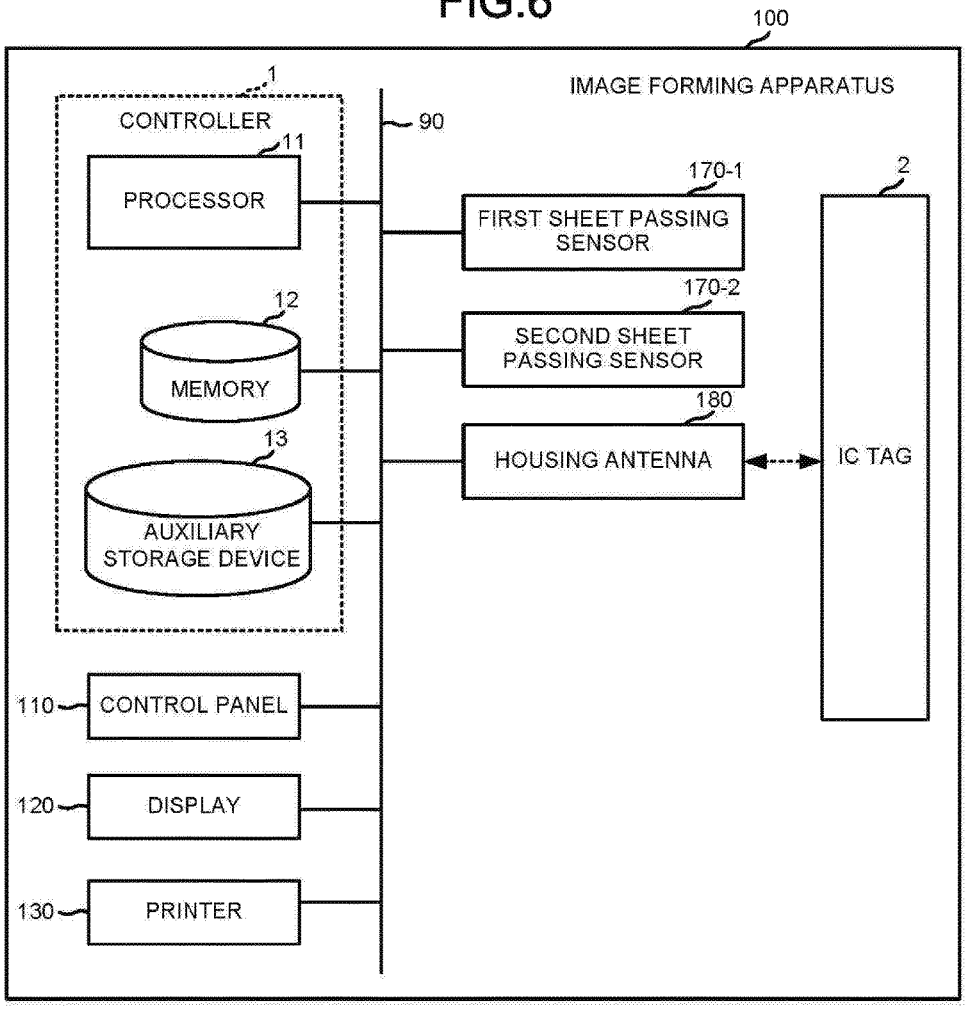
FIG. 5 is a diagram illustrating a specific example of individual roller management information according to the embodiment.
FIG. 6 is a diagram illustrating a specific example of the hardware structure of the image forming apparatus according to the embodiment.

FIG. 5 is a diagram illustrating a specific example of the individual roller management information according to the embodiment. For example, the individual roller management information is stored in the tag storage section 205 as an individual roller management information table 901 shown in FIG. 5. The tag storage section 205 has one record having each value of a roller ID and a roller rotation angle. The roller ID indicates the identification number of the conveyance roller 160. The roller rotation angle indicates the magnitude of the cumulative angle of the conveyance roller 160 with an ID represented by the roller ID. For example, the example in FIG. 5 shows that the identification number of the conveyance roller including the tag storage section 205 storing the information in FIG. 5 is A-1. Furthermore, the example in FIG. 5 shows that the magnitude of the cumulative angle of the conveyance roller 160 whose identification number is indicated by A-1 is 16,000 deg. The roller rotation angle is updated each time the conveyance roller 160 to which the IC tag 2 is attached rotates.

In the present embodiment, it is assumed that the identification number of the conveyance roller 160-*i* described in FIG. 1 is A-i. The conveyance roller 160 including the tag storage section 205 storing the information in FIG. 5 is the conveyance roller 160-1 whose identification number is A-1.

Returning to the description in FIG. 4. If the tag controller 206 is supplied with the power, the individual roller management information stored in the tag storage section 205 is acquired. The tag controller 206 controls the communication controller 207 to transmit the individual roller management information to the housing antenna 180 via the tag antenna 201.

The communication controller 207 controls the current or the voltage applied to the tag antenna 201 to generate the electromagnetic wave and transmits the individual roller management information to the housing antenna 180.

FIG. 6 is a diagram illustrating a specific example of the hardware structure of the image forming apparatus 100 according to the embodiment. The image forming apparatus 100 includes a processor 11, a memory 12, an auxiliary storage device 13, and the like connected via a bus line 90, and executes a program. The image forming apparatus 100 functions as an apparatus including the control panel 120, the display 110, the printer 130, the first sheet passing sensor 170-1, the second sheet passing sensor 170-2, the housing antenna 180, the controller 1 and the IC tag 2 by executing the program. All or a part of the functions of the image forming apparatus 100 may be realized by using hardware such as an ASIC (Application Specific Integrated Circuit), a PLD (Programmable Logic Device), and an FPGA (Field Programmable Gate Array). The program may be recorded on a computer-readable recording medium. The computer-readable recording medium is, for example, a portable medium such as a flexible disk, a magneto-optical disk, a ROM, a CD-ROM or the like, or a storage device such as a hard disk built in a computer system. The program may be transmitted via an electric communication line.

In FIG. 6, the components same as those in FIG. 1, FIG. 2 and FIG. 3 are donated with the same reference numerals, and the description thereof is omitted.

The auxiliary storage device 13 stores the roller management information. The roller management information indicates the cumulative angle of the conveyance roller 160 of the image forming apparatus 100. The roller management information indicates a first roller rotation angle, a second roller rotation angle, a set angle difference and an allowable angle difference.

The first roller rotation angle indicates the magnitude of the cumulative angle contained in the individual roller management information stored in the tag storage section 205 at a time point at which the first sheet passing sensor 170-1 detects the sheet.

The second roller rotation angle indicates the magnitude of the cumulative angle contained in the individual roller management information stored in the tag storage section 205 at a time point at which the second sheet passing sensor 170-2 detects the sheet.

The set angle difference is a predetermined value at the time of designing the image forming apparatus 100 for each conveyance roller 160. The set angle difference is an angle at which the conveyance roller 160 rotates at the time the sheet is conveyed from the first detection position to the second detection position.

The allowable angle difference is a reference value at the time of determining whether or not the replacement time of the conveyance roller 160 arrives (hereinafter, referred to as a "replacement determination".). For example, the allowable angle difference is used at the time the image forming apparatus 100 determines the replacement of the conveyance roller 160 as follows. The image forming apparatus 100 determines the replacement depending on whether a difference between the first roller rotation angle and the second roller rotation angle is within a range from the set angle difference to an angle of the sum of the set angle difference and the allowable angle difference.

Figures 7, 8:
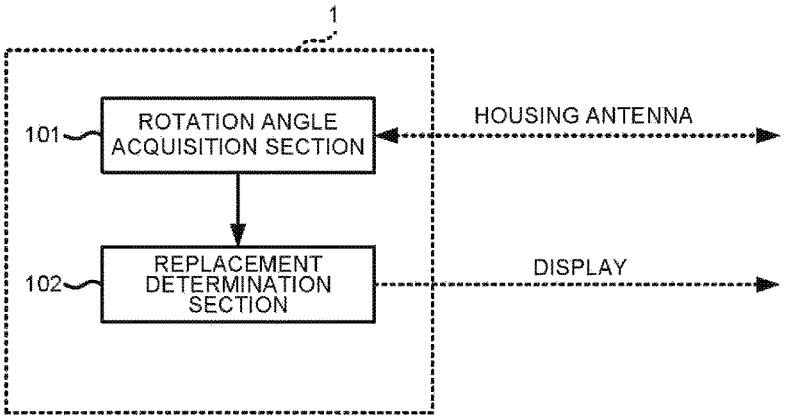
FIG. 7 is a diagram illustrating a specific example of the roller management information according to the embodiment.
FIG. 8 is a diagram illustrating a specific example of the functional components as controllers of the image forming apparatus according to the embodiment.

FIG. 7 is a diagram illustrating a specific example of the roller management information according to the embodiment. For example, the roller management information is stored in the auxiliary storage device 13 as the roller management information table 902 shown in FIG. 7. The auxiliary storage device 13 has one record for each roller ID. Each record has each value of the roller ID, a first acquisition angle, a second acquisition angle, a normal rotation angle difference, and an angle difference range. Similar to FIG. 5, the roller ID represents the identification number identifying the conveyance roller 160.

The first acquisition angle indicates a first roller rotation angle. The second acquisition angle indicates a second roller rotation angle. The normal rotation angle difference indicates the set angle difference. The angle difference range indicates a range of an angle indicated by the allowable angle range.

For example, a record 992 indicates that the first roller rotation angle of the conveyance roller 160 whose identification number is A-1 is 93,000 deg. The record 992 indicates that the second roller rotation angle of the conveyance roller 160 whose identification number is A-1 is 103,000 deg. The record 992 indicates that the set angle difference predetermined for the conveyance roller 160 whose identification number is A-1 is 10,000 deg. In addition, the record 992 indicates that the allowable angle difference predefined for the conveyance roller 160 whose identification number is A-1 is 200 deg.

Returning to the description in FIG. 6. The processor 11, the memory 12, and the auxiliary storage device 13 function as the controller 1 of the image forming apparatus 100 by executing a program stored in the memory 12 and the auxiliary storage device 13 by the processor 11.

FIG. 8 is a diagram illustrating a specific example of the functional components of the controller 1 in the image forming apparatus 100 according to the embodiment. For example, the processor 11 reads the programs stored in the auxiliary storage device 13 onto the memory 12 and sequentially executes them, thereby realizing the function of the controller 1. The controller 1 has functional sections including a rotation angle acquisition section 101 and a replacement determination section 102 by executing the program.

The rotation angle acquisition section 101 radiates the electromagnetic wave to the IC tag 2 via the housing antenna 180. The rotation angle acquisition section 101 acquires the individual roller management information from the IC tag 2 via the housing antenna 180.

The replacement determination section 102 executes a replacement determination based on the magnitude of the cumulative angle contained in the individual roller management information acquired by the rotation angle acquisition section 101. The replacement determination section 102 determines whether to replace the conveyance roller 160 attached with the IC tag 2 which is a transmission source of the individual roller management information acquired by the rotation angle acquisition section 101 according to a predetermined method based on the magnitude of the acquired cumulative angle. The replacement determination section 102 displays the determination result on the display 110.

Figure 9:
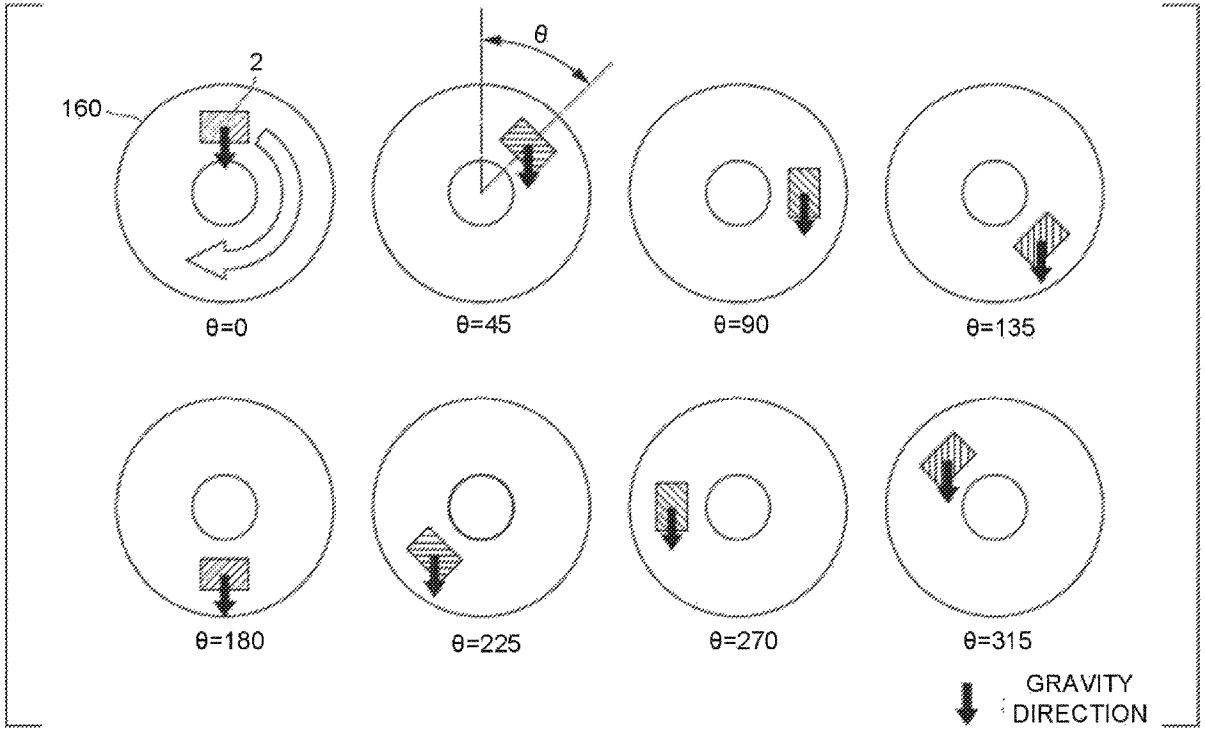
FIG. 9 is a diagram illustrating that a direction of gravitational acceleration of the IC tag is changed by rotation of the conveyance roller according to the embodiment.

FIG. 9 is a diagram illustrating that a direction of gravitational acceleration of the IC tag 2 is changed by the rotation of the conveyance roller 160 according to the embodiment. In FIG. 9, the rotation angle of the conveyance roller 160 is represented by Θ. In FIG. 9, the direction of the gravitational acceleration is a direction indicated by an arrow. The direction of the gravitational acceleration is a direction from a center point of the IC tag 2 to a center point of the conveyance roller 160 if Θ=0.

In the example in FIG. 9, the conveyance roller 160 rotates from Θ=0 deg to Θ=315 deg. As the conveyance roller 160 rotates, the IC tag 2 attached to the conveyance roller 160 also rotates. Therefore, due to the rotation, a line connecting the center point of the IC tag 2 and the center point of the conveyance roller 160 is not parallel to the direction of the gravitational acceleration. Therefore, the direction of the gravitational acceleration of the IC tag 2 changes according to the rotation of the conveyance roller 160.

Figure 10:
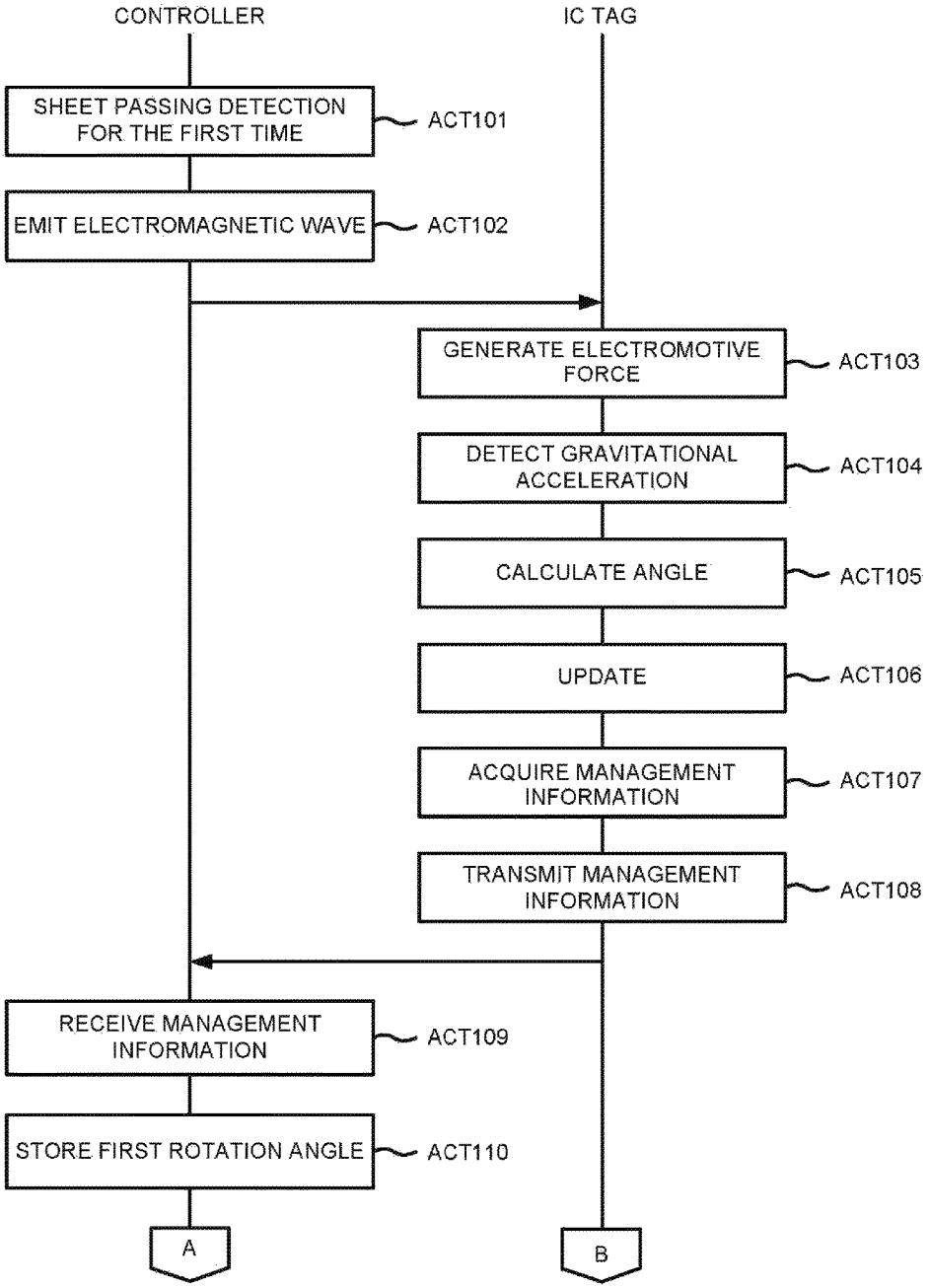
FIG. 10 is a sequence diagram illustrating the flow of a replacement determination processing for the conveyance roller by the image forming apparatus according to the embodiment.
Figure 11:
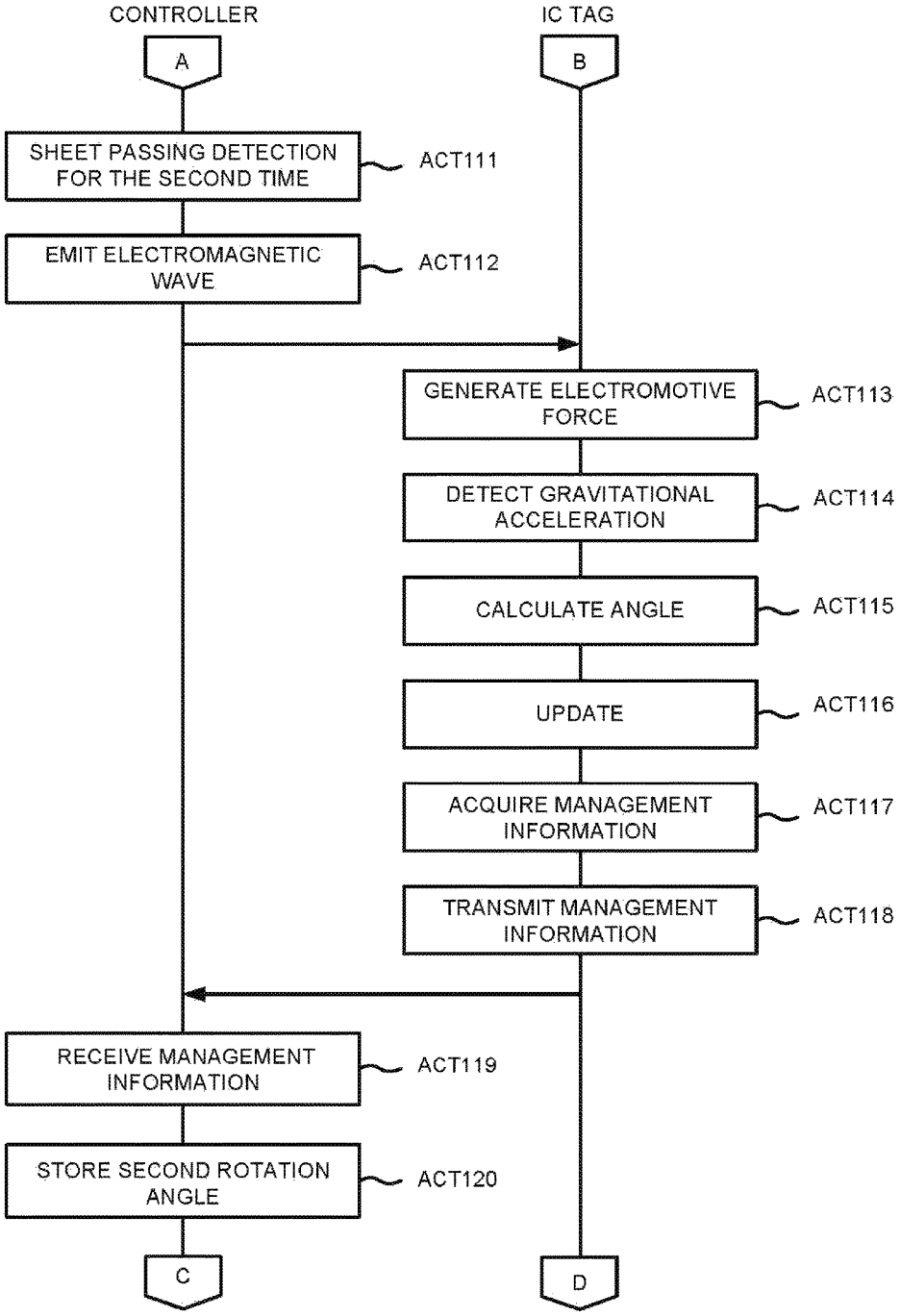
FIG. 11 is a sequence diagram illustrating the flow of the replacement determination processing for the conveyance roller by the image forming apparatus according to the embodiment.
Figure 12:
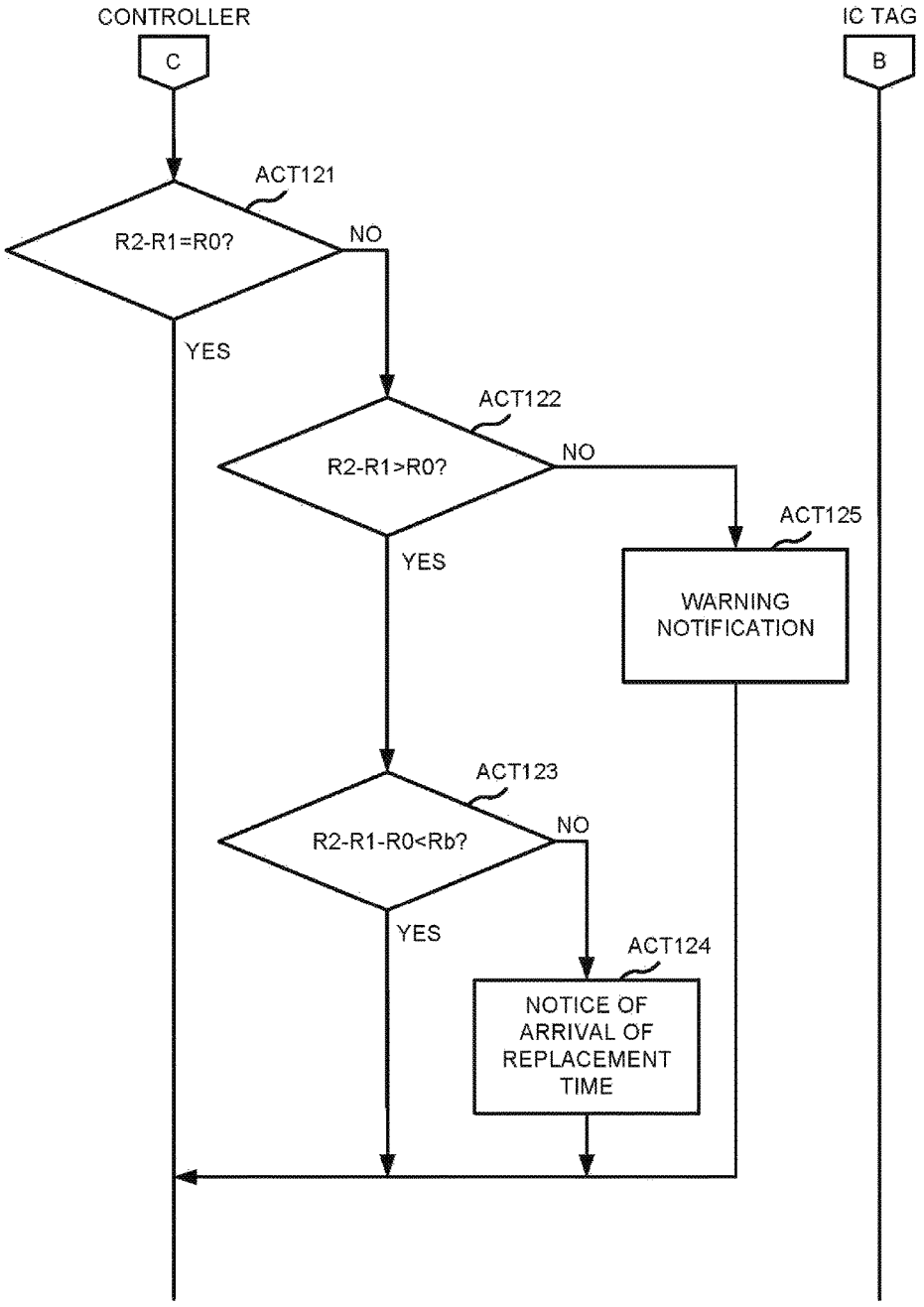
FIG. 12 is a sequence diagram illustrating the flow of the replacement determination processing for the conveyance roller by the image forming apparatus according to the embodiment.

FIG. 10~FIG. 12 are sequence diagrams illustrating the flow of a replacement determination processing for the conveyance roller 160 by the image forming apparatus 100 according to the embodiment. Hereinafter, the flow of a processing in a case in which the replacement determination processing (hereinafter referred to as replacement determination processing) is executed on one conveyance roller 160 is described. If the replacement determination processing is executed on a plurality of the conveyance rollers 160, the processing described in FIG. 10~FIG. 12 is executed for each of the plurality of conveyance rollers 160. Hereinafter, a case in which the roller management information is stored in the auxiliary storage device 13 as the roller management information table 902 is described as the specific example.

In FIG. 12, the first roller rotation angle, the second roller rotation angle, the set angle difference and the allowable angle difference are represented by R1, R2, R0 and Rb, respectively.

The first sheet passing sensor 170-1 detects that the sheet passes the first detection position (ACT 101). The rotation angle acquisition section 101 excites the housing antenna 180 to radiate the electromagnetic wave (ACT 102). The IC tag 2 receives the electromagnetic wave radiated by the housing antenna 180 with the tag antenna 201. The IC tag 2 converts the received electromagnetic wave to the electric power supplied to each functional section of the IC tag 2 with the power conversion section 202 (ACT 103). The acceleration sensor 203 supplied with the power detects a change in the direction of the gravitational acceleration applied thereto due to the rotation of the conveyance roller 160 and outputs the gravity signal (ACT 104). The rotation angle calculation section 204 acquires the gravity signal and calculates the cumulative angle (ACT 105). The rotation angle calculation section 204 updates the magnitude of the cumulative angle included in the individual roller management information stored in the tag storage section 205 with the value obtained in ACT 105 (ACT 106).

The tag controller 206 acquires the individual roller management information stored in the tag storage section 205 (ACT 107). The communication controller 207 acquires the individual roller management information acquired by the tag controller 206. The communication controller 207 transmits the individual roller management information to the housing antenna 180 via the tag antenna 201 (ACT 108).

The rotation angle acquisition section 101 receives the individual roller management information transmitted via the tag antenna 201 through the housing antenna 180 (ACT 109). The rotation angle acquisition section 101 refers to the roller management information table 902 stored in the auxiliary storage device 13.

The rotation angle acquisition section 101 selects the record in the roller management information table 902 with the identification number contained in the acquired individual roller management information set as the identification number indicated by the roller ID. The rotation angle acquisition section 101 overwrites the value of the first acquisition angle in the selected record by the magnitude of the cumulative angle contained in the acquired individual roller management information (ACT 110).

The second sheet passing sensor 170-2 detects that the sheet passes through the second detection position (ACT 111). The rotation angle acquisition section 101 excites the housing antenna 180 to radiate the electromagnetic wave (ACT 112). The IC tag 2 receives the electromagnetic wave radiated by the housing antenna 180 with the tag antenna 201. The IC tag 2 converts the received electromagnetic wave to the electric power supplied to each functional section of the IC tag 2 with the power conversion section 202 (ACT 113). The acceleration sensor 203 supplied with the power detects a change in the direction of the gravitational acceleration applied the conveyance roller 160 due to the rotation of the conveyance roller 160 and outputs the gravity signal (ACT 114). The rotation angle calculation section 204 acquires the gravity signal and calculates the cumulative angle (ACT 115). The rotation angle calculation section 204 updates the magnitude of the cumulative angle included in the individual roller management information stored in the tag storage section 205 with the value obtained in ACT 115 (ACT 116).

The tag controller 206 acquires the individual roller management information stored in the tag storage section 205 (ACT 117). The communication controller 207 acquires the individual roller management information acquired by the tag controller 206. The communication controller 207 transmits the individual roller management information to the housing antenna 180 via the tag antenna 201 (ACT 118).

The rotation angle acquisition section 101 receives the individual roller management information transmitted via the tag antenna 201 through the housing antenna 180 (ACT 109). The rotation angle acquisition section 101 refers to the roller management information table 902 stored in the auxiliary storage device 13.

The rotation angle acquisition section 101 selects the record in the roller management information table 902 with the identification number contained in the individual roller management information acquired in ACT 119 set as the identification number indicated by the roller ID. The rotation angle acquisition section 101 overwrites the value of the second acquisition angle in the selected record by the magnitude of the cumulative angle contained in the acquired individual roller management information (ACT 120).

The replacement determination section 102 acquires the values of the first acquisition angle and the second acquisition angle in the record selected in the ACT 120 to calculate an absolute value of a difference therebetween. The replacement determination section 102 determines whether or not the absolute value of the difference therebetween (hereinafter, referred to as a "first determination angle") is the same as the value of the normal rotation angle difference in the selected record (ACT 121). If the replacement determination section 102 determines that the first determination angle is equal to the value of the normal rotation angle difference (Yes in ACT 121), the image forming apparatus 100 enters a standby state without displaying a notification.

On the other hand, if the replacement determination section 102 determines that the first determination angle is different from the value of the normal rotation angle difference (No in ACT 121), the replacement determination section 102 executes the following processing. The replacement determination section 102 determines whether or not the first determination angle is greater than the value of the normal rotation angle difference (ACT 122). If the replacement determination section 102 determines that the first determination angle is greater than the value of the normal rotation angle difference (Yes in ACT 122), the replacement determination section 102 executes the following processing. The replacement determination section 102 determines whether or not a second determination angle is less than the value of the angle difference range of the record selected in ACT 120 (ACT 123). The second determination angle is an absolute value of the difference between the first determination angle and the value of the normal rotation angle difference. If the replacement determination section 102 determines that the second determination angle is smaller than the value of the angle difference range (Yes in ACT 123), the image forming apparatus 100 enters the standby state without displaying the notification.

On the other hand, if the replacement determination section 102 determines that the second determination angle is equal to or greater than the angle difference range value (No in ACT 123), the replacement determination section 102 executes the following processing. The replacement determination section 102 outputs a signal instructing the display 110 to display that the replacement time of the conveyance roller 160 arrives to the display 110 (ACT 124). A case in which the determination in ACT 123 is No means that the conveyance roller 160 exceeds the allowable range with respect to the designed time due to abrasion, that the diameter of the roller becomes small, and that the rotation is large during conveyance of the sheet. Therefore, the replacement determination section 102 determines that the replacement time of the conveyance roller 160 arrives.

On the other hand, if the replacement determination section 102 determines that the first determination angle is equal to or less than the value of the normal rotation angle difference (No in ACT 122), the replacement determination section 102 executes the following processing. The replacement determination section 102 outputs a signal to the display 110 to instruct the display 110 to display that the conveyance roller 160 is abnormal (ACT 125). A case in which the determination in ACT 122 is No means that the conveyance roller 160 exceeds the allowable range at the design time due to deposit or the like and the diameter of the roller is increased. Alternatively, if the conveyance roller 160 is the driven roller, as the driven roller moves to a position different from an installation location at the time of designing, the conveyance roller 160 is not in sufficient contact with the sheet. In this case, the sheet is conveyed mainly by rotation of the driving roller and the driven roller cannot convey the sheet sufficiently. Therefore, the first determination angle of the driven roller is smaller than that at the time of designing. Therefore, the replacement determination section 102 determines that the replacement time of the conveyance roller 160 arrives.

Since the image forming apparatus 100 constituted in this way has the conveyance roller 160 provided with the acceleration sensor 203, a user can know that the appropriate replacement time of the conveyance roller 160 arrives.

The IC tag 2 of the embodiment is not necessarily attached to only the conveyance roller, and may be attached to any roller as long as it is a roller. For example, the IC tag 2 may be attached to a roller such as a pickup roller.

(Modification)

The roller management information may further include roller type information, counter roller information and roller diameter information. The roller type information indicates whether the conveyance roller 160 is the driving roller or the driven roller. The counter roller information indicates the conveyance roller 160 facing each conveyance roller 160 for each conveyance roller 160. The roller diameter information indicates a diameter of the conveyance roller 160.

FIG. 13 is a diagram illustrating a specific example of the roller management information according to the modification. For example, the roller management information is stored in the auxiliary storage device 13 as a roller management information table 903 shown in FIG. 13. The roller management information table 903 has a record for each roller ID. Each record has values of the roller ID, the first acquisition angle, the second acquisition angle, a roller type, a counter roller, and a roller diameter. The roller ID, the first acquisition angle, and the second acquisition angle are the same as those in FIG. 7.

The roller type indicates whether the conveyance roller 160 identified by the identification number represented by the corresponding roller ID is the driving roller or the driven roller.

The counter roller represents a roller facing the conveyance roller 160 with the identification number represented by the corresponding roller ID. The counter roller is used for sandwiching the sheet with the conveyance roller 160 to convey the sheet. Specifically, for example, the conveyance roller 160-2 is the counter roller of the conveyance roller 160-1 in FIG. 2.

The roller diameter represents the diameter of the conveyance roller 160 with the identification number represented by the corresponding roller ID.

For example, a record 993 indicates that the first roller rotation angle of the conveyance roller 160 whose identification number is A-5 is 3,000 deg. The record 993 indicates that the second roller rotation angle of the conveyance roller 160 whose identification number is A-5 is 6,000 deg. The record 993 indicates that the conveyance roller 160 whose identification number is A-5 is the driving roller. The record 993 indicates that the roller facing the conveyance roller 160 whose identification number is A-5 is the conveyance roller 160 whose identification number is A-6. The record 993 indicates that the conveyance roller 160 whose identification number is A-5 has a diameter of 3 cm.

Figure 14:
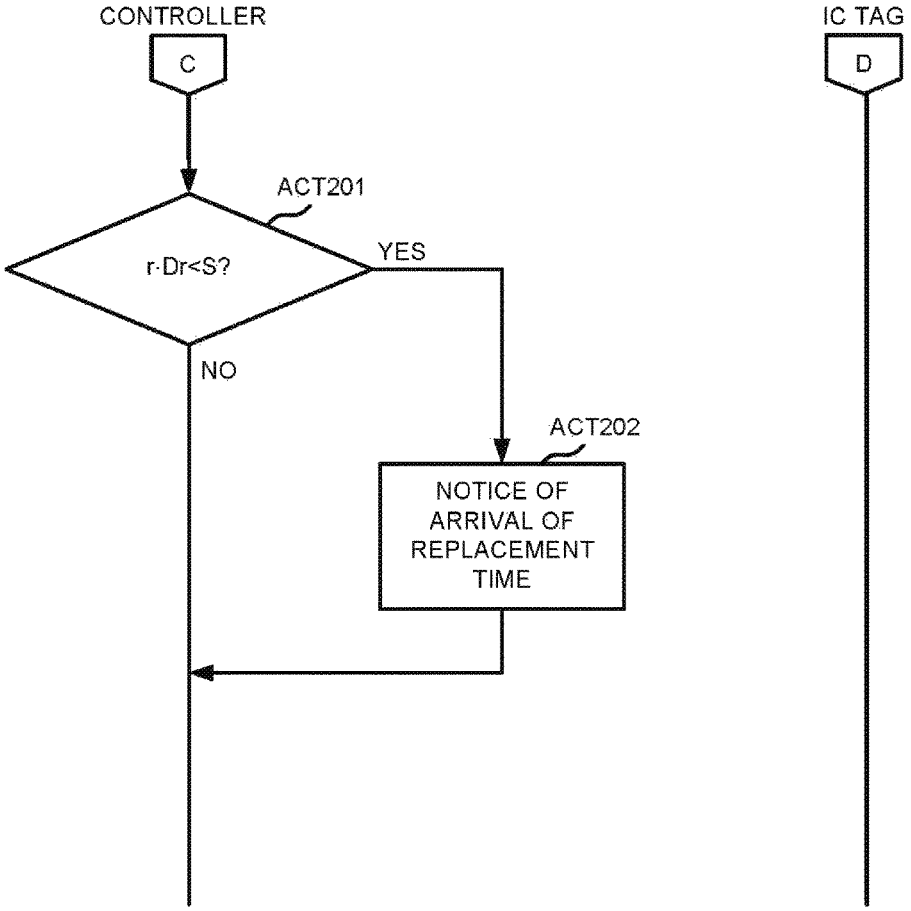
FIG. 14 is a sequence diagram illustrating the flow of the replacement determination processing for the conveyance roller by the image forming apparatus according to the modification.

FIG. 14 is a sequence diagram illustrating the flow of the replacement determination processing on the conveyance roller 160 by the image forming apparatus 100 according to the modification.

The ACT 201 in FIG. 14 is a processing following the processing in ACT 120 in FIG. 11. The processing before ACT 201 in FIG. 14 is the same processing as that in ACTs 101-120 in FIG. 10 and FIG. 11. Therefore, in the description of the flow of the replacement determination processing on the conveyance roller 160 by the image forming apparatus 100 according to the modification, the description in ACTs 101-120 is omitted. For the sake of simplicity, the flow of a processing if the replacement determination processing is executed on one driving roller 160 and one driven roller 160 facing thereto is described. In the case in which the replacement determination processing is executed on a plurality of the driving rollers 160 and the driven rollers 160 facing them, the processing described below is executed on each of the plurality of the driving rollers 160 and the driven rollers 160 facing them, respectively.

In addition, the conveyance roller whose identification number is A-5 and the conveyance roller opposed thereto whose identification number is A-6 are described below as the specific example.

The replacement determination section 102 refers to the roller management information table 903 to select a record in which the type represented by the roller type is the driving roller. The replacement determination section 102 selects a record in which the identification number indicated by the roller ID is A-5. The replacement determination section 102 acquires a value of the roller diameter (hereinafter, referred to as "driving diameter") in the selected record.

The replacement determination section 102 acquires the values of the first acquisition angle and the second acquisition angle in the selected record to calculate the first determination angle. Hereinafter, the calculated first determination angle is referred to as a determination angle for driving.

The replacement determination section 102 selects a record in which the identification number indicated by the counter roller in the selected record is set as identification number indicated by the roller ID. The replacement determination section 102 selects a record in which the identification number indicated by the roller ID is A-6. The replacement determination section 102 acquires a value of the roller diameter (hereinafter, referred to as "driven diameter") in the selected record.

The replacement determination section 102 acquires the value of the first acquisition angle and the value of the second acquisition angle in the selected record to calculate the first determination angle. Hereinafter, the calculated first calculation angle is referred to as a determination angle for driven.

The replacement determination section 102 calculates a ratio of the driven diameter to the driving diameter (hereinafter referred to as a "diameter ratio"). The replacement determination section 102 calculates a ratio (hereinafter referred to as an "angle ratio") of the determination angle for driven to the determination angle for driving.

The replacement determination section 102 determines whether or not a product of the diameter ratio and the angle ratio is smaller than a predetermined reference value (ACT 201). The predetermined reference value is previously stored in the auxiliary storage device 13 and used for determining whether or not the replacement time of the conveyance roller arrives. In FIG. 14, the predetermined reference value is represented by S.

If the product of the diameter ratio and the angle ratio is smaller than the predetermined reference value (Yes in ACT 201), the replacement determination section 102 executes the following processing. The replacement determination section 102 outputs a signal to the display 110 to instruct the display 110 to display that the replacement time of the conveyance roller 160-5 whose the identification number is A-5 and the conveyance roller 160-6 whose the identification number is A-6 arrives (ACT 202). In FIG. 14, the diameter ratio is represented by Dr and the angle ratio is represented by r.

The driving roller and the driven roller rotate by a length of a distance (hereinafter referred to as a "sheet conveyance distance") at which the sheet is conveyed at the time of conveying the sheet. At the time of conveying the sheet, the angle at which the conveyance roller 160 rotates is sheet conveyance distance*360/(diameter*circle ratio).

Therefore, if there is no sliding between the driving roller 160 and the sheet, the product of the diameter ratio and the angle ratio is 1. However, if the driving roller slips, the product of the diameter ratio and the angle ratio is less than 1. Therefore, if the conveyance roller 160 exceeds the allowable range due to abrasion or the like and is in a slipping state, the replacement determination section 102 determines that the replacement time of the conveyance roller 160 arrives. The predetermined reference value is a predetermined value for representing the allowable range.

On the other hand, if the product of the diameter ratio and the angle ratio is equal to or greater than the predetermined reference value (No in ACT 201), the image forming apparatus 100 enters the standby state without displaying the notification.

The image forming apparatus 100 of the modification constituted in this way includes the counter roller information, the roller type information and the roller diameter information in the roller management information, and thus, the image forming apparatus 100 can determine whether or not the replacement time of the driving roller and the driven roller arrives.

The image forming apparatus 100 of the modification may execute the same processing as in the case of No determination in ACT 122 if the product of the diameter ratio and the angle ratio is larger than the predetermined value. The replacement determination section 102 may output a signal to the display 110 to instruct the display 110 to display that an abnormality occurs in the conveyance roller 160. The predetermined value is a threshold value for determining whether or not the value of the product of the diameter ratio and the angle ratio exceeds an allowable amount if the product is larger than 1.

The image forming apparatus of the modification determines whether or not the replacement time of the driving roller and the driven roller arrives by using the product of the diameter ratio and the angle ratio. However, the diameter ratio does not necessarily have to be the diameter ratio as long as it is a physical quantity correlated with the angle ratio. For example, if the conveyance roller 160 has a constant density regardless of location, a ratio of the weight of the driving roller to the weight of the driven roller may be used instead of the diameter ratio.

In the present embodiment, the case in which the sheet conveyance apparatus is the image forming apparatus is described as the specific example. However, as long as it is the apparatus conveying the sheet by rollers, the sheet conveyance apparatus is not necessarily the image forming apparatus. For example, the conveyance roller used in a conveyance apparatus used for a postal matter, a scanner such as an image reading device, a finisher of a multifunction peripheral, or the like may be used.

The image forming apparatus 100 of the embodiment may display the roller management information on the display 110.

The rotation angle calculation section 204 is an example of a rotation angle acquisition section. The housing antenna 180 is an example of a power supply section. The electromagnetic wave is an example of wireless.

The sum of the set angle difference and the allowable angle difference is an example of a first threshold value. The set angle difference is an example of a second threshold value.

The first detected position is an example of a first passing point, and the second detected position is an example of a second passing point.

According to at least one embodiment described above, the conveyance roller 160 with the acceleration sensor 203 is provided so that the user can know that the appropriate replacement time of the conveyance roller 160 arrives.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet conveyance apparatus, comprising:

a roller configured to convey a sheet;

an acceleration sensor, attached to the roller, configured to output a signal indicating a direction of gravitational acceleration applied to the roller at the time the roller rotates; and a controller configured to:

acquire cumulative angle at which the roller rotates in a predetermined period based on the signal output by the acceleration sensor in the predetermined period, determine whether to replace the roller based on the acquired cumulative angle, wherein the controller determines whether or not replacement time of the roller arrives if an angle at which the roller rotates in a period from a moment the sheet passes through a first passing point on a conveyance path to a moment the sheet passes through a second passing point located at the downstream side of the first passing point in a conveyance direction of the sheet exceeds a first threshold value predetermined based on a distance between the first passing point and the second passing point.

2. The sheet conveyance apparatus according to claim 1, wherein the controller determines that the replacement time of the roller does not arrive if the angle at which the roller rotates in a period from a moment the sheet passes through the first passing point to a moment the sheet passes through the second passing point is smaller than the first threshold value and equal to or greater than a predetermined second threshold value.

3. The sheet conveyance apparatus according to claim 2, wherein the controller determines that abnormality occurs in the roller if the angle at which the roller rotates in a period from a moment the sheet passes through the first passing point to a moment the sheet passes through the second passing point is smaller than the second threshold value.

4. The sheet conveyance apparatus according to claim 1, wherein a first roller to which power is supplied and a second roller rotated by the first roller are included as the roller, a first acceleration sensor, attached to the first roller, configured to output a signal indicating a direction of gravitational acceleration applied to the first roller at the time the first roller rotates and a second acceleration sensor, attached to the second roller, configured to output a signal indicating a direction of gravitational acceleration applied to the second roller at the time the second roller rotates are included as the acceleration sensor, and the controller determines replacement time of the first and second rollers depending on a ratio of an angle at which the first roller rotates to an angle at which the second roller rotates in a period from a moment the sheet conveyed the first and second rollers passes through the first passing point on the conveyance path of the sheet to a moment the sheet passes through the second passing point located at the downstream side of the first passing point in the conveyance direction of the sheet and a ratio of a predetermined physical quantity relating to a magnitude of the first roller to the predetermined physical quantity relating to a magnitude of the second roller.

5. The sheet conveyance apparatus according to claim 4, wherein the predetermined physical quantity is a length of circumference.

6. The sheet conveyance apparatus according to claim 4, wherein the predetermined physical quantity is a weight.

7. The sheet conveyance apparatus according to claim 1, further comprising:

a power supply section configured to supply power to the acceleration sensor wirelessly.

8. The sheet conveyance apparatus according to claim 1, wherein the roller is molded by embedding the acceleration sensor therein.

9. A sheet conveyance method, including:

conveying a sheet by a roller;

outputting a signal indicating a direction of gravitational acceleration applied to the roller at the time the roller rotates by an acceleration sensor attached to the roller;

acquiring an angle at which the roller rotates based on the signal output by the acceleration sensor; and determining whether to replace the roller based on the acquired angle, wherein the controller determines whether or not replacement time of the roller arrives if an angle at which the roller rotates in a period from a moment the sheet passes through a first passing point on a conveyance path to a moment the sheet passes through a second passing point located at the downstream side of the first passing point in a conveyance direction of the sheet exceeds a first threshold value predetermined based on a distance between the first passing point and the second passing point.

* * * * *